US008726579B2

(12) United States Patent
Peck

(10) Patent No.: US 8,726,579 B2
(45) Date of Patent: May 20, 2014

(54) MODULAR CONTAINER SYSTEM

(76) Inventor: Gunnar Peck, Schildow (DE)

( * ) Notice: Subject to any disclaimer, the term of this patent is extended or adjusted under 35 U.S.C. 154(b) by 152 days.

(21) Appl. No.: 13/146,181

(22) PCT Filed: Oct. 8, 2009

(86) PCT No.: PCT/DE2009/075057

§ 371 (c)(1),
(2), (4) Date: Aug. 12, 2011

(87) PCT Pub. No.: WO2010/083798

PCT Pub. Date: Jul. 29, 2010

(65) Prior Publication Data

US 2012/0017519 A1 Jan. 26, 2012

(30) Foreign Application Priority Data

Jan. 26, 2009 (DE) ..... 10 2009 006 553
Sep. 20, 2009 (DE) ..... 10 2009 044 059

(51) Int. Cl.

| | |
|---|---|
| ***E04H 1/00*** | (2006.01) |
| ***E04H 3/00*** | (2006.01) |
| ***E04H 5/00*** | (2006.01) |
| ***E04B 1/343*** | (2006.01) |

(52) U.S. Cl.

CPC ..... *E04B 1/34315* (2013.01); *E04B 1/34321* (2013.01)

USPC ..... 52/79.1

(58) Field of Classification Search

CPC . E04B 1/34315; E04B 1/34384; E04B 1/343; E04B 1/34321; E04B 7/022; E04B 2001/343; E04B 2001/34389; E04H 1/12; E04H 1/1205; E04H 1/1277

USPC ..... 52/79.1–79.5, 79.9, 128, 136

See application file for complete search history.

(56) References Cited

U.S. PATENT DOCUMENTS

| | | | | |
|---|---|---|---|---|
| 3,785,096 | A * | 1/1974 | Neuhardt | 52/79.4 |
| 4,037,380 | A * | 7/1977 | Pollock | 52/475.1 |
| 4,067,159 | A * | 1/1978 | Juriss et al. | 52/234 |
| 4,391,077 | A * | 7/1983 | Giess | 52/748.11 |
| 4,470,227 | A * | 9/1984 | Bigelow et al. | 52/79.1 |
| 5,036,638 | A * | 8/1991 | Kurtz, Jr. | 52/284 |
| D370,982 | S * | 6/1996 | Shane | D25/33 |
| 6,899,240 | B2 * | 5/2005 | Dang et al. | 220/3.8 |
| 7,543,411 | B2 * | 6/2009 | Whitehead et al. | 52/66 |
| 8,132,372 | B2 * | 3/2012 | Mower et al. | 52/79.1 |
| 8,381,455 | B2 * | 2/2013 | Schooley | 52/79.9 |
| 8,429,858 | B1 * | 4/2013 | Robinson et al. | 52/79.5 |
| 2002/0100235 | A1 * | 8/2002 | Weiss | 52/220.2 |
| 2002/0193046 | A1 * | 12/2002 | Zebersky | 446/476 |
| 2004/0040223 | A1 * | 3/2004 | De La Marche | 52/79.9 |
| 2004/0237418 | A1 * | 12/2004 | MacBeth MacWatt | 52/79.1 |
| 2004/0237419 | A1 * | 12/2004 | MacWatt | 52/79.1 |
| 2005/0193643 | A1 * | 9/2005 | Pettus | 52/79.1 |
| 2007/0175108 | A1 * | 8/2007 | Stein et al. | 52/79.5 |
| 2007/0245638 | A1 * | 10/2007 | Lai | 52/79.1 |
| 2009/0031621 | A1 * | 2/2009 | Kitagawa | 47/17 |

(Continued)

*Primary Examiner* — Mark Wendell
*Assistant Examiner* — Keith Minter
(74) *Attorney, Agent, or Firm* — Dominic A. Frisina

(57) ABSTRACT

The invention relates to a modular container system for creating cuboid modular units for living or working purposes, which are arranged next to and on top of each other. In order to enable cost-effective warehousing, easy transportation, fast assembly, and a flexible and variable installation, it is proposed that a modular unit may comprise a variety of interconnecting floor, ceiling and wall elements.

15 Claims, 18 Drawing Sheets

(56) References Cited

U.S. PATENT DOCUMENTS

| | | | | |
|---|---|---|---|---|
| 2009/0165399 | A1* | 7/2009 | Campos Gines | 52/79.1 |
| 2011/0047890 | A1* | 3/2011 | Lucht | 52/79.5 |
| 2012/0000142 | A1* | 1/2012 | McKimmy et al. | 52/79.1 |
| 2012/0005969 | A1* | 1/2012 | Broden | 52/79.9 |
| 2012/0110926 | A1* | 5/2012 | Phillips et al. | 52/79.9 |
| 2012/0180403 | A1* | 7/2012 | Kull et al. | 52/79.1 |
| 2013/0014450 | A1* | 1/2013 | Esposito | 52/11 |

* cited by examiner

MODULAR CONTAINER SYSTEM

I. BACKGROUND OF THE INVENTION

A. Field of Invention

The invention relates to a modular container system for creating block-shaped room modules for living or working purposes, which are disposed next to and on top of one another.

B. Description of the Related Art

Office containers of the type stated are used everywhere where fixed, non-mobile facilities are considered not to be cost-effective or economical. Containers of the aforementioned type are particularly intended for being able to make livable space available quickly and flexibly, for example for use as office space, hospital rooms, operating rooms, and the like. Usually, such containers are block-shaped, pre-finished room modules that are combined, next to one another and stacked, on site, to produce a structure.

It is a disadvantage of the known container systems that they cannot be modified and can only be adapted with difficulty to changed spatial concepts. This requires keeping different container types on hand, causing long idle times. This is particularly true for custom-made containers. In the end result, use of materials, capital tie-up, and the demand for storage space are high. Transport of the containers is uneconomical, since enclosed spaces must be transported, which require a large loading area and frequent trips. Furthermore, strong cranes are needed for lifting, loading, and setting down the containers in the storage area and on the site.

It is therefore the task of the invention to propose a modular container system that allows cost-advantageous storage, simple transport, fast assembly/disassembly, and flexible and variable setup and dismantling.

II. SUMMARY OF THE INVENTION

This task is accomplished in that a room module comprises, in each instance: a) a floor or ceiling element that serves as a lower base, having push-on connector parts for releasable attachment of two face wall elements that lie opposite one another, b) two face wall elements having push-on connector parts for releasable attachment on the floor or ceiling element and having push-on connector parts for releasable attachment of an upper ceiling or roof element, as well as push-on connector parts for a connection with side wall elements, c) two side wall elements having push-on connector parts for a connection with the face wall elements, d) a ceiling or roof element that serves as an upper cover, having push-on connector parts for releasable attachment to the face wall elements. This container system has numerous advantages as compared with the known container systems. For example, a complete room module is only built up on site, from the individual elements described. Before that, the individual elements can be stored and transported in space-saving manner, and therefore the storage and transport costs are lower than in the case of the known container systems. Another advantage lies in that during assembly, a crane having a lower carrying capacity can be used, since the individual elements have a lower weight than a complete room module. An additional advantage lies in that the individual elements merely have to be put together by means of push-on connectors when setting up the container system. It is not necessary to screw the individual elements together, for example, or to connect them in some other manner. In this way, fast and cost-advantageous assembly and also disassembly are obtained.

Advantageous embodiments are indicated in the dependent claims and will be explained below.

A push-on connector is composed of at least two push-on connector parts, where at least one connector part is provided on those elements, in each instance, that are supposed to be connected with one another. A push-on connector part has a groove with at least one tongue-and-groove piece that runs parallel to it, so that in the case of a push-on connector consisting of push-on connector parts that have been put together, the grooves and tongue-and-groove pieces engage into one another with shape fit, with their contact surfaces. In this way, a simple but secure push-on connection is possible, without additional attachment means being required.

The side wall elements are shaped as a trapezoid having a lower base side and an upper base side that runs parallel to the latter, and two equal trapezoid sides. In this connection, the sides and the lower base side form an inside angle of greater than 90°, in each instance, thereby causing the surface of the side wall elements to narrow toward the lower floor or ceiling element, and to widen toward the upper cover. The push-on connector parts for a connection with the face wall elements run along the trapezoid sides and have their inclination. The push-on connector parts of the face wall elements for a connection with the side wall elements have the same direction of inclination and can thus be connected with them. In this way, a component of the force that is produced by the weight of the trapezoid-shaped side wall element acts in the horizontal direction, in other words parallel to the base sides. In this way, the push-on connector parts are connected with one another by force by the side wall elements and the face wall elements, and pressed together. One side wall element, in each instance, is thus firmly braced between two face wall elements.

For two room modules disposed next to one another, in each instance, a common, inner side wall element is provided as an inner wall. In this way, in contrast to conventional containers, a side wall is saved.

All the face wall elements and the outer side wall elements of the container system that are not inner walls form the outer walls of the container system.

The inner side wall elements have push-on connectors having two tongue-and-groove pieces and a double groove disposed between them, so that in the connected state, the two tongue-and-groove pieces of the two push-on connector parts of two face wall elements disposed next to one another jointly engage into the double groove, and one of the two tongue-and-groove pieces of the inner side wall element, in each instance, engages into a groove of the push-on connector part of a face wall element, in each instance, in order to connect two face wall elements and to connect them with an inner side wall element. In this way, the common side wall element can firmly connect two face wall elements with one push-on connector part on the trapezoid side, in each instance.

The floor, ceiling, or roof elements are configured as panels, preferably rectangular, having a top, an underside, and four side surfaces, in each instance, where the push-on connector parts for a connection to the face wall elements are disposed, in particular, on two side surfaces that lie opposite one another, in each instance, and the longitudinal axes of groove and tongue-and-groove piece run parallel to the side surfaces. In this connection, the underside of the floor elements lies directly on the ground surface in the assembled state of the container system, and the top of the floor elements faces toward the ceiling or roof element. The roof elements form the upper end of the container system with their top. The ceiling elements form the floor of an upper room module with their top, and the ceiling of a lower room module with their underside.

The face wall elements have an upper and a lower push-on connector part. When the container system is set up, the face wall elements are set onto a floor or ceiling element with the lower push-on connector part, and a ceiling or roof element is set onto the upper push-on connector part.

For the floor elements, push-on connector parts having a groove and a tongue-and-groove piece are provided, which are disposed on the top of the floor elements, in other words face a ceiling or roof element, so that the lower push-on connector parts of the face wall elements can be set onto the top of the floor element.

For the roof elements, push-on connector parts having a groove and a tongue-and-groove piece are provided, which are disposed on the underside of the roof elements, in other words face a ceiling or floor element, so that the roof elements can be set onto the upper push-on connector parts of the face wall elements with their underside.

For the ceiling elements, push-on connector parts having a groove and a tongue-and-groove piece are provided, which are disposed on the top of the ceiling elements, so that the lower push-on connector parts of the face wall elements can be set onto the top of the ceiling elements. In addition, further push-on connector parts having grooves and tongue-and-groove pieces are provided for the ceiling elements, which parts are disposed on the underside of the ceiling elements, so that the ceiling elements can be set onto the upper push-on connector parts of the face wall elements with their underside.

The side wall elements for the uppermost level have attachment elements for attachment of the roof elements in the contact region of the roof elements.

The attachment elements are configured as a thickened region that runs longitudinally or as a projection that runs longitudinally, having a holding surface for the roof elements, so that in the assembled state, the side wall elements exert a force on the roof elements by means of their weight, with the holding surface, and attach them. This is made possible in that the side wall elements are not bearing elements, but rather are suspended into or set into the face wall elements.

The outer side wall elements have a cover plate that is preferably rectangular. The face wall elements are covered by the cover plate.

The floor, ceiling, face wall, side wall, and roof elements have a seal, preferably a hard-rubber layer, at the locations or surfaces where they can come into contact with one another in the connected state. In this way, the room modules are sealed and protected with regard to ambient influences, such as rain, moisture, outdoor temperatures, and the like.

Since the face wall elements are always outer walls, they have doors and/or windows.

The inner or outer side wall elements can have passage openings or doors.

The individual components of the container system, such as floor elements, ceiling elements, face wall elements, side wall elements, roof element, and the like, consist of aluminum profiles that form a frame. In this way, great stability is guaranteed at low weight. Likewise, the push-on connector parts consist of aluminum profiles. Facings are disposed on the frame, where the outside wall facings and roof surfaces consist of zinc-plated, weather-resistant corrugated metal sheets, and the inside wall, floor and ceiling facings consist of scratch-resistant and impact-resistant plastic panels. The contact surfaces of the push-on connector parts are provided with a sealing hard-rubber layer, in order to avoid weather influences. The cavities of the components can be filled, as necessary, with heat-insulating, noise-insulating, or fire-insulating materials. The weight of the components, as required in each instance, can be precisely adjusted by means of the amount and type of filling. Heating systems, air conditioning equipment, lighting equipment, switches/regulators, etc., and ducts for the supply lines, communications lines, roof water drainage, etc., can be preinstalled in the cavities.

The invention will be described as an example, making reference to a drawing, where further advantageous details can be derived from the figures of the drawing.

Functionally equivalent parts are provided with the same reference symbols. For a differentiation of functionally equivalent parts on different components, some of the reference symbols have indices.

III. BRIEF DESCRIPTION OF THE DRAWINGS

The figures of the drawing show, in detail:

FIG. 1 is a side view of the container system having a floor element 1, which forms a base for the face wall element 4 and the side wall element 5;

FIG. 2 is a side view of the container system from FIG. 1 with the floor element 1 shown with a broken line, two face wall elements 4 set on, and an inner side wall element 5 that is inserted between the two face wall elements 4;

FIG. 6 is a top view of three floor elements 1 from FIG. 5 with all six face wall elements 4 set on;

Figure 6:
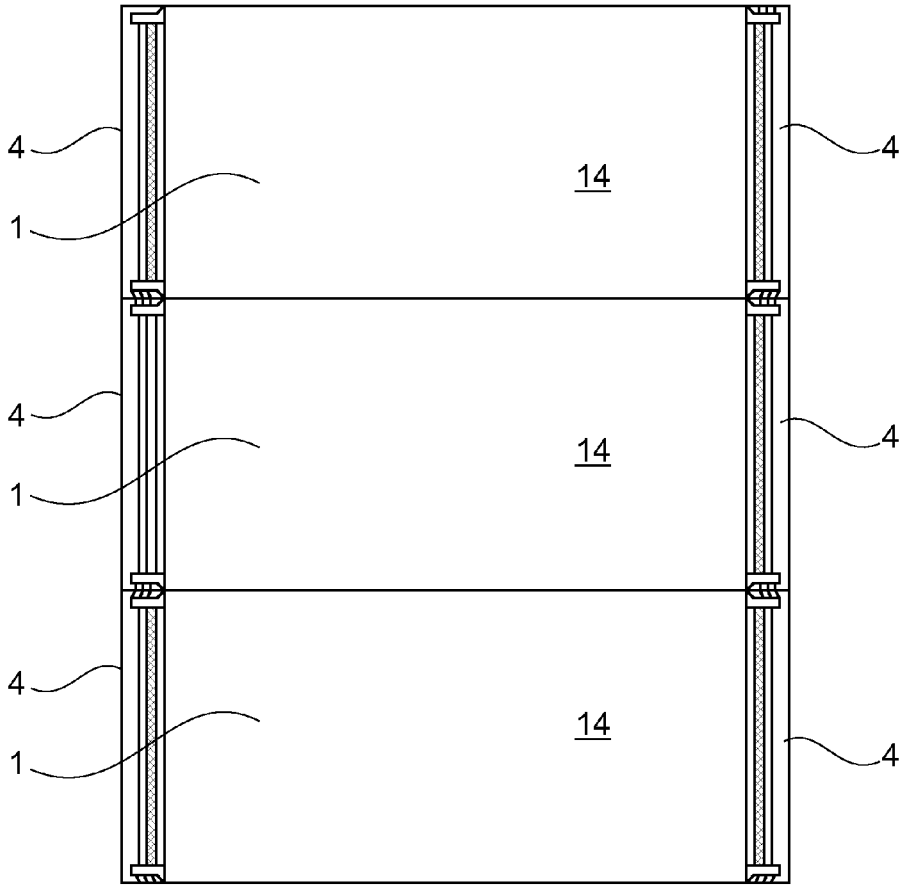
Figure 7:
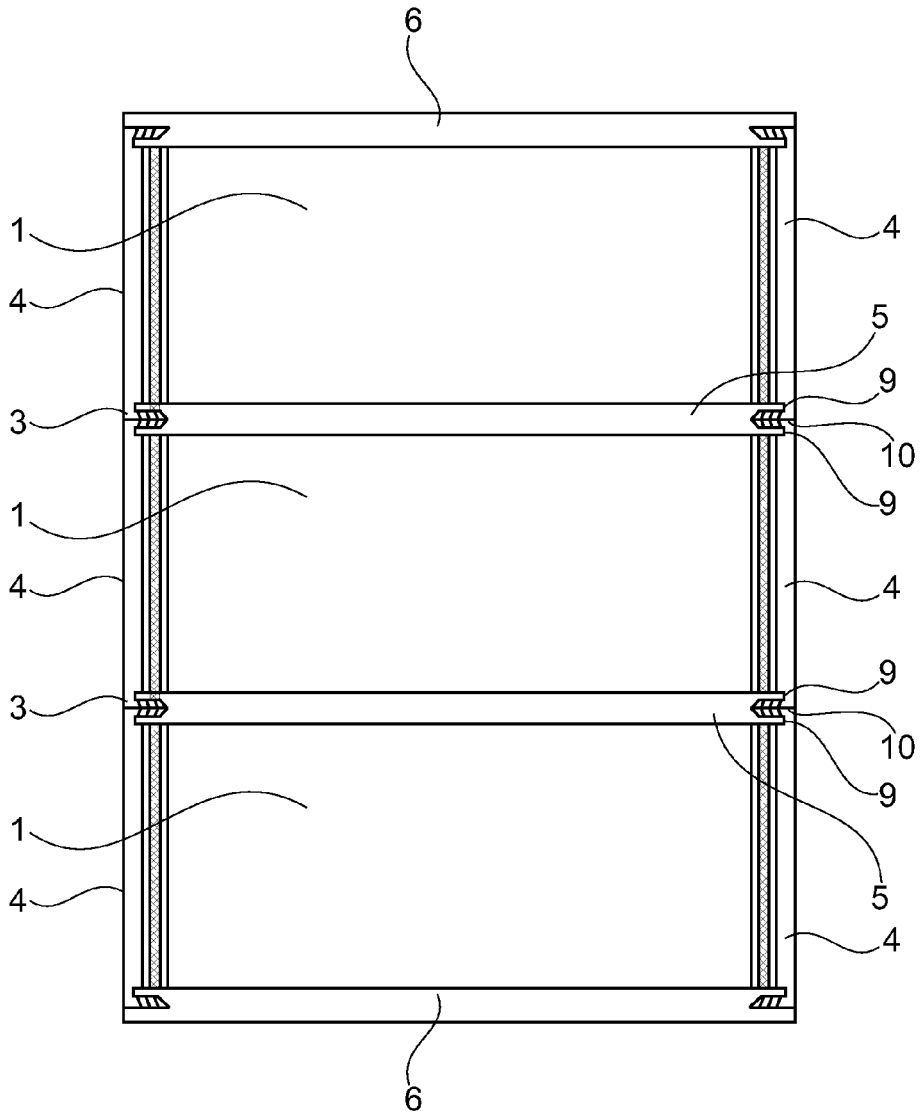
Figure 8:
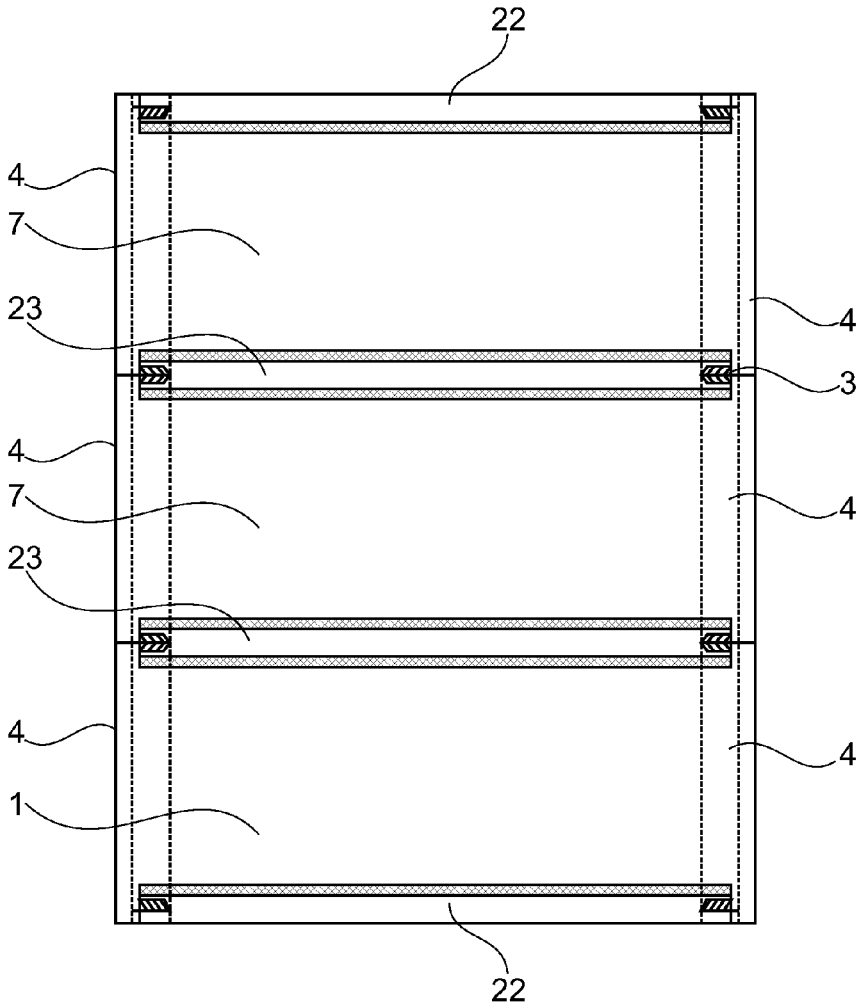
Figure 9:
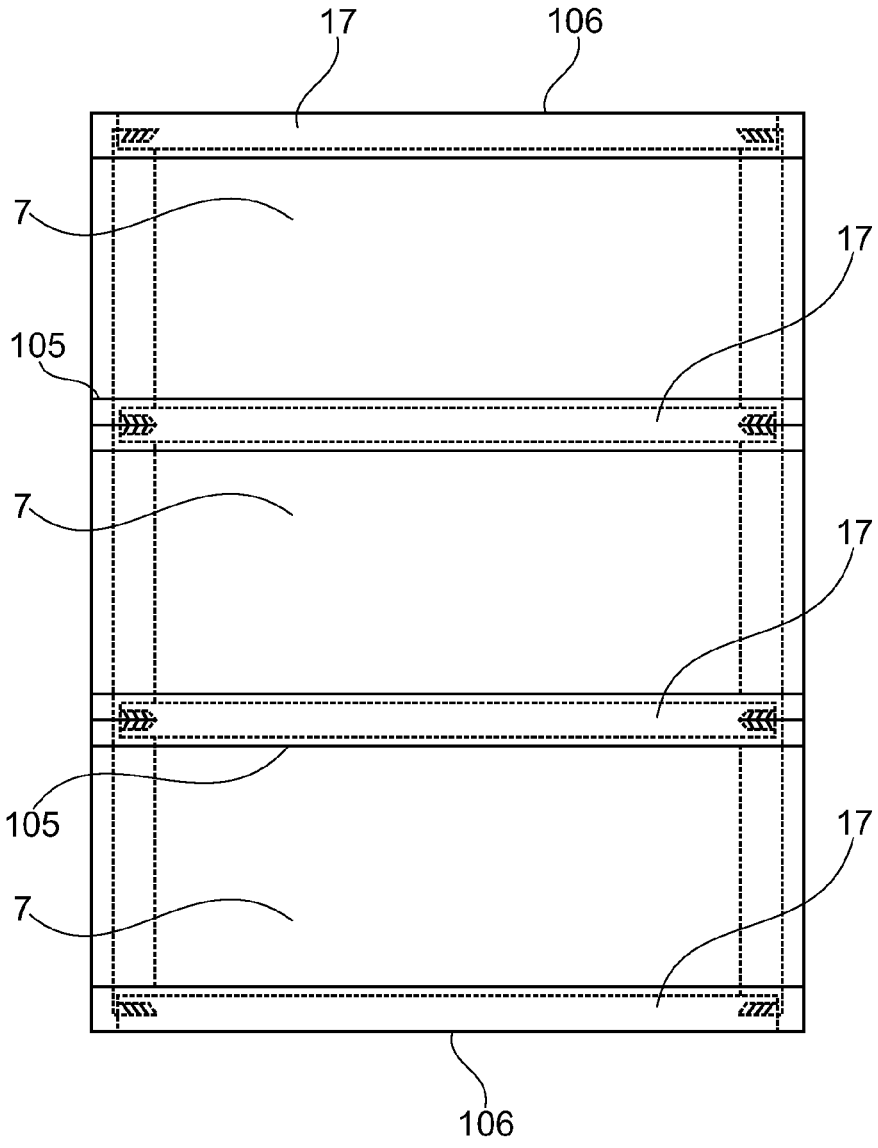
Figure 10:
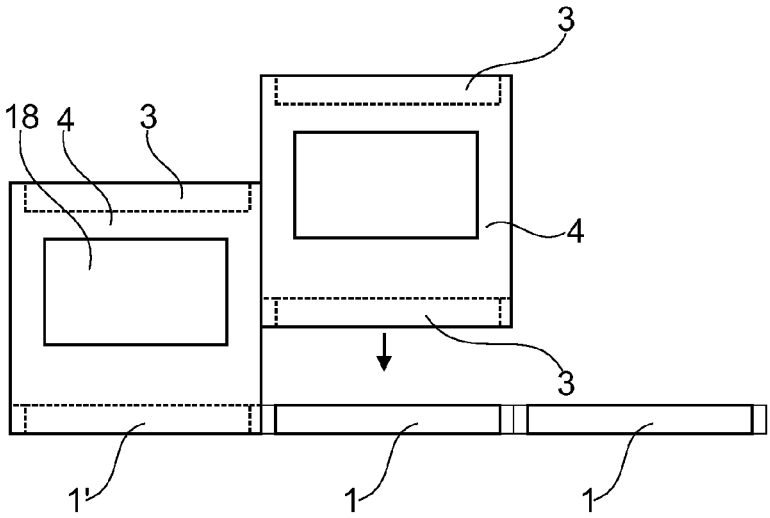
Figure 11:
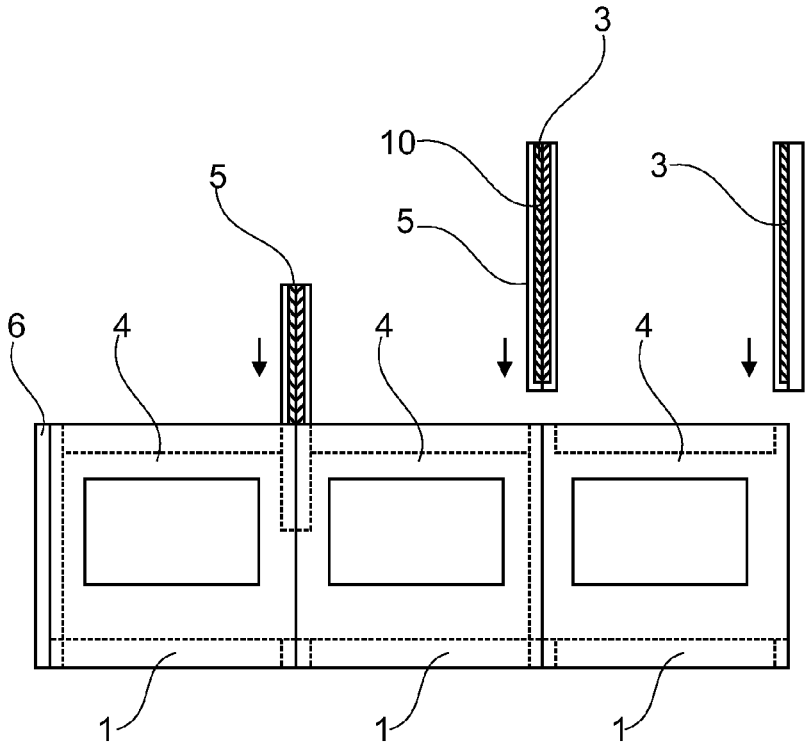
Figure 12:
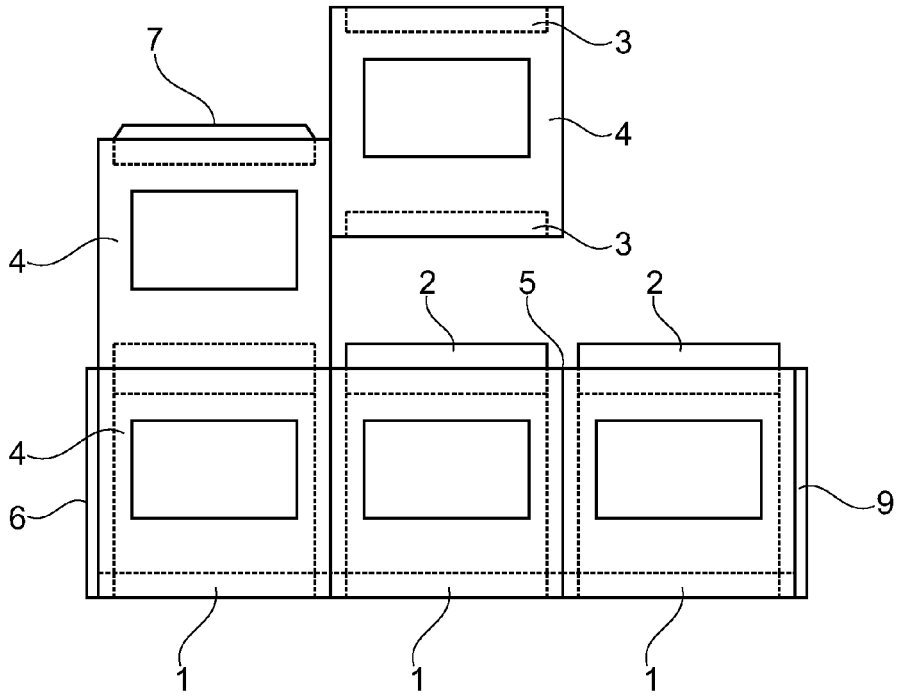
Figure 13:
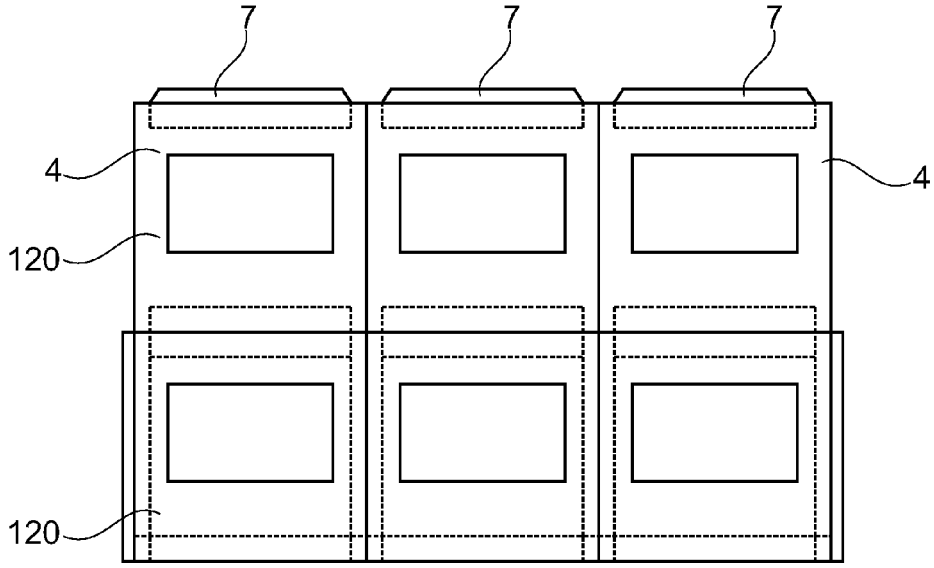
Figure 14:
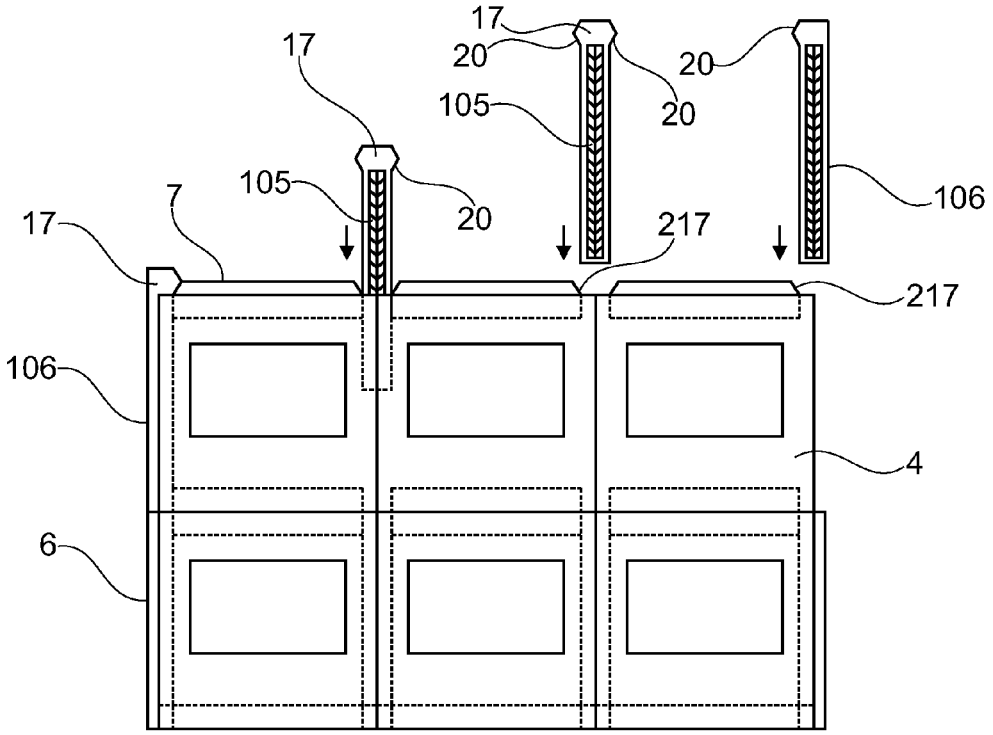
Figure 15:
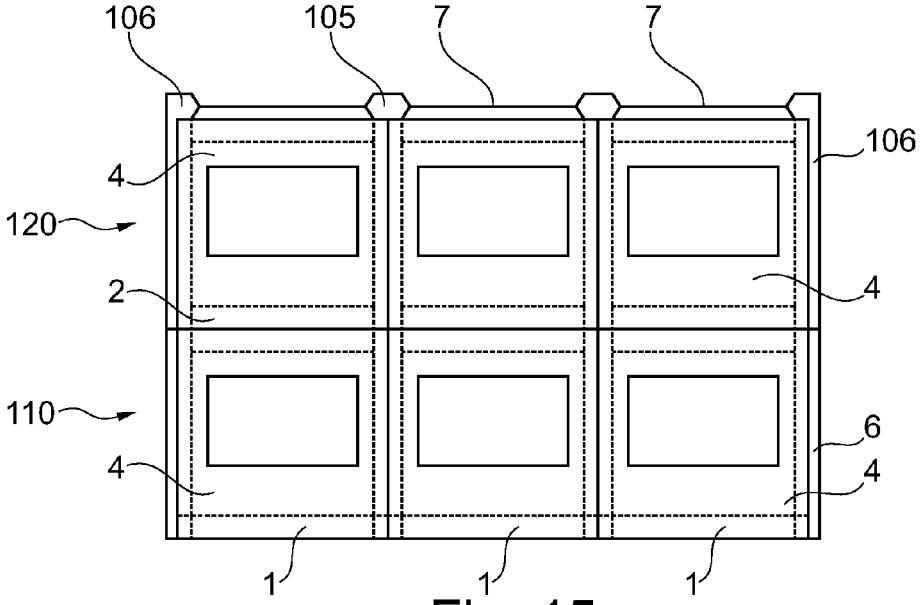
Figure 16A:
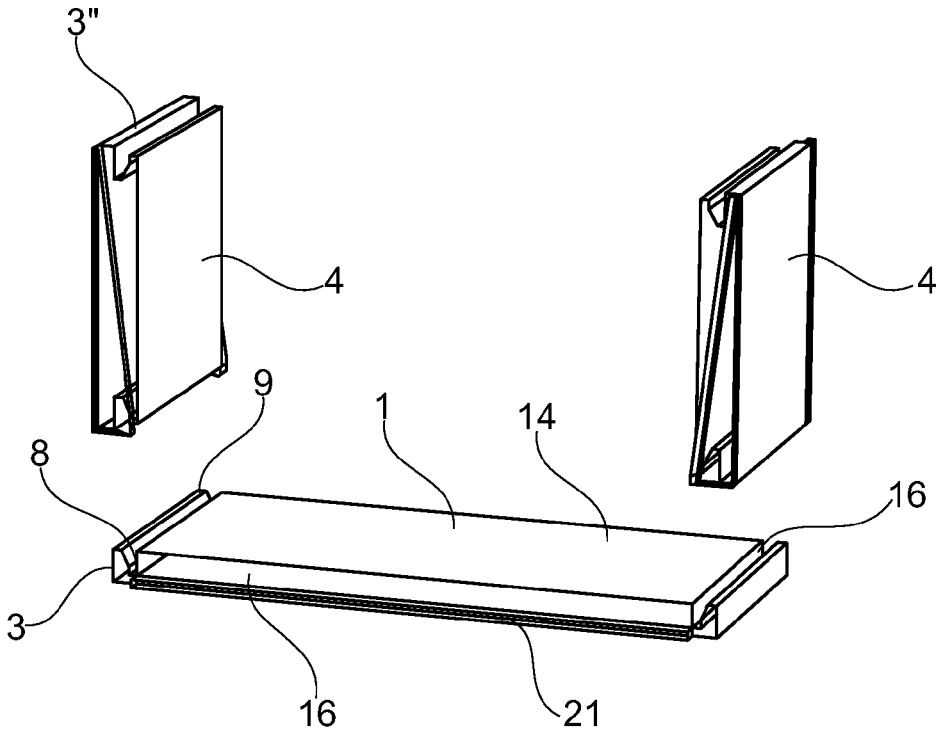
Figure 16B:
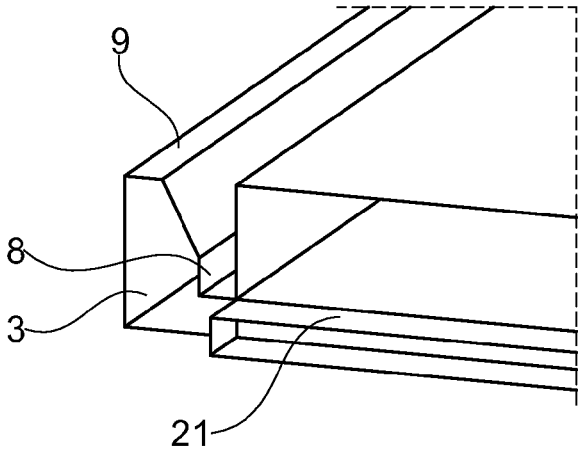
Figure 17A:
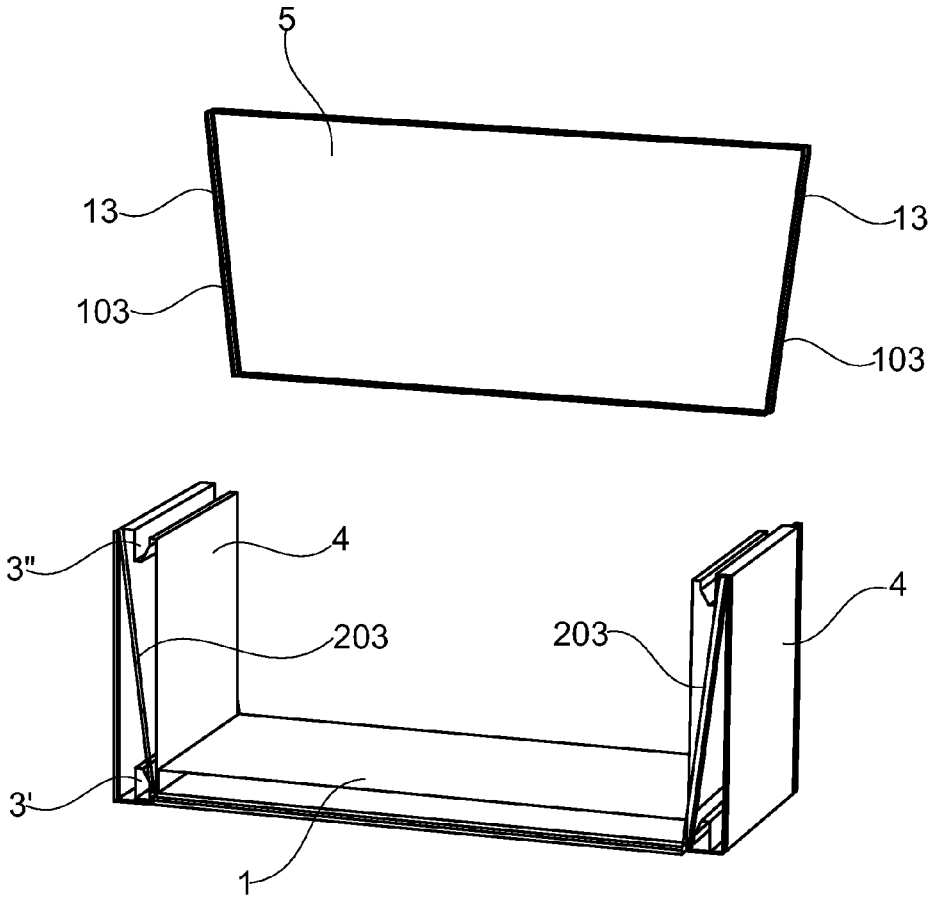
Figure 17B:
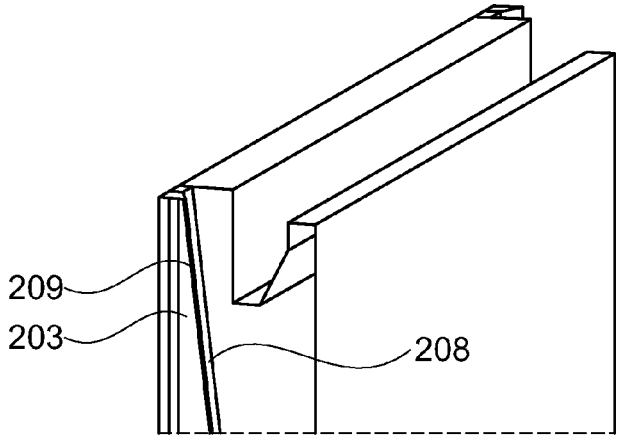
Figure 18:
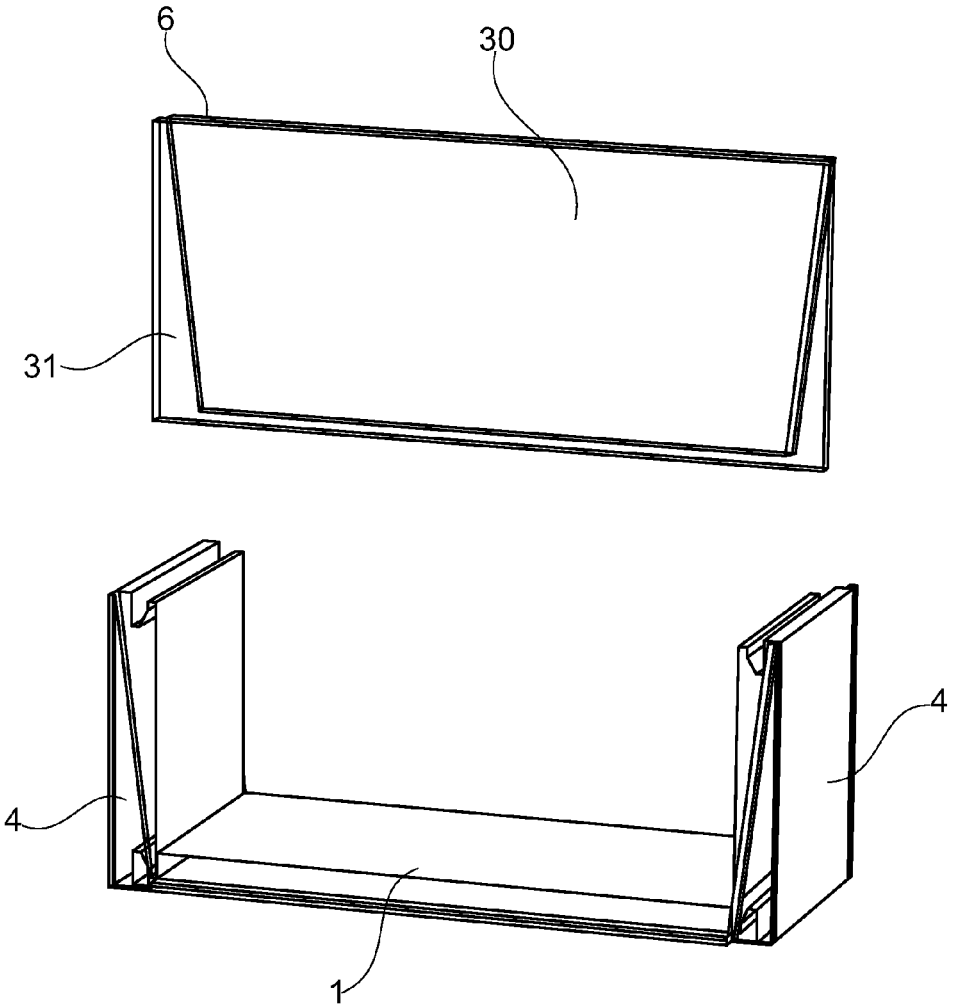
Figure 19:
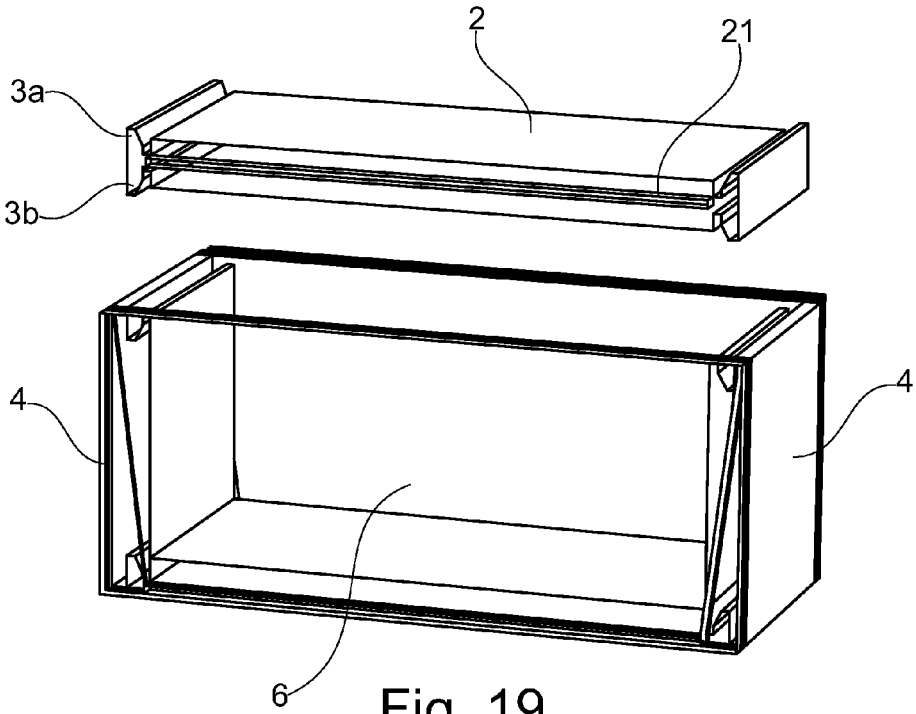
Figure 20:
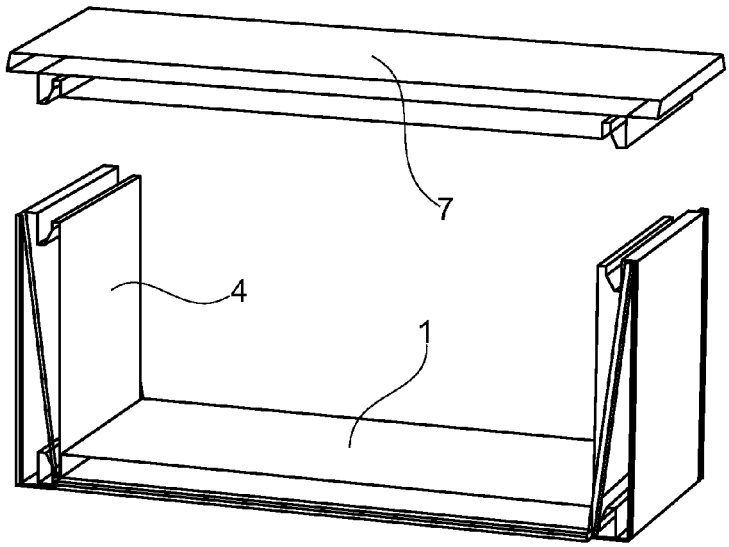
Figure 21:
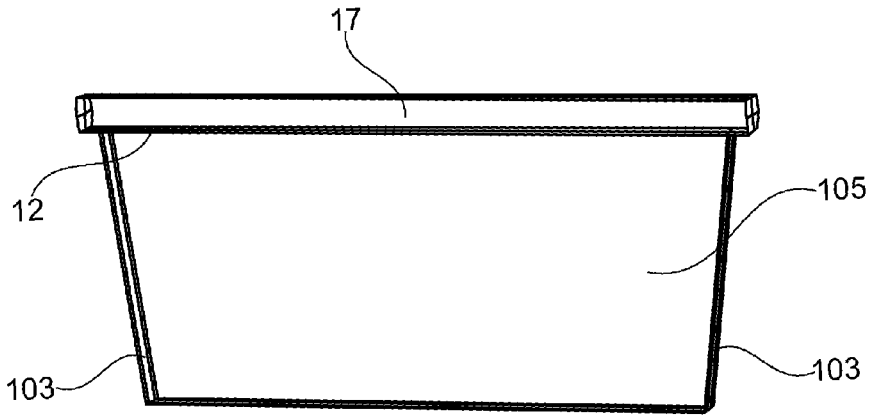
Figure 22:
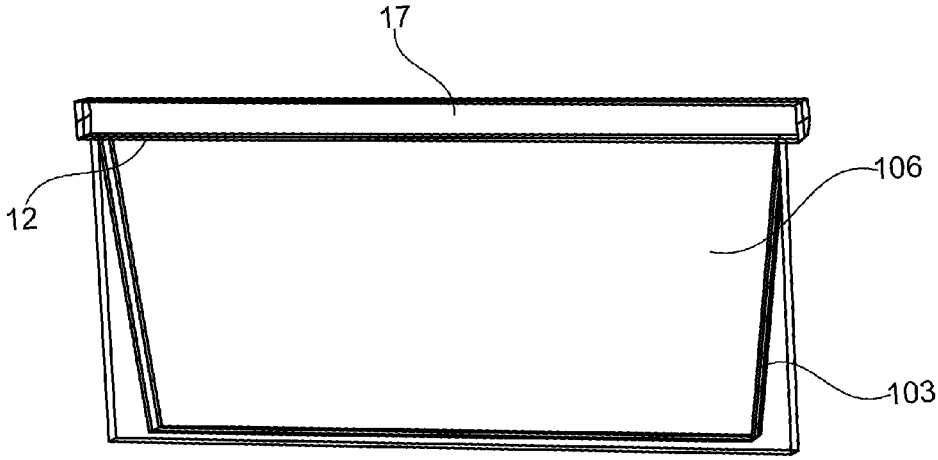
Figure 23:
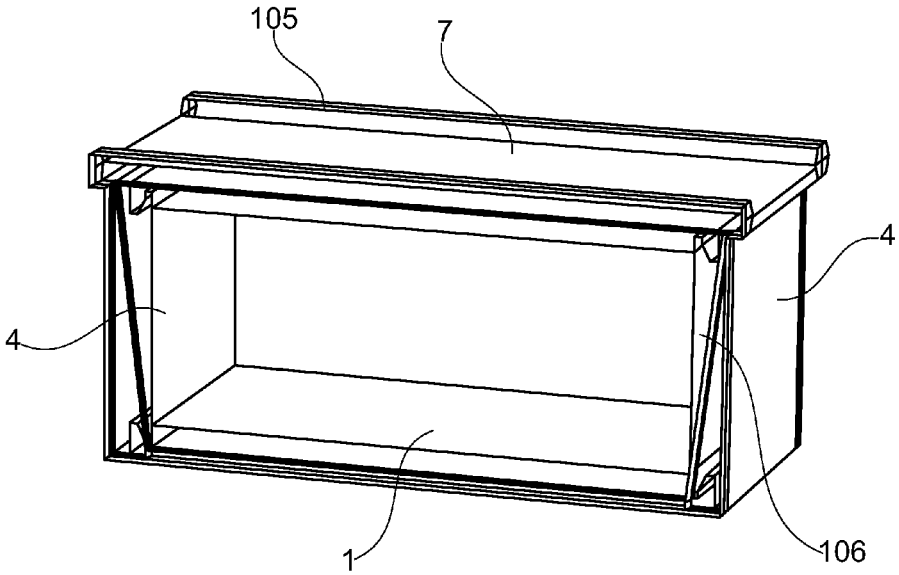

FIG. 7 shows the three floor elements 1 with face wall elements 4 from FIG. 6 together with the inner side wall elements 5 and the outer side wall elements set on;

FIG. 8 shows the container system from FIG. 7, where in addition, three ceiling elements 2 (not shown), six upper face wall elements 4 (not shown), and three roof elements 7 are set on;

FIG. 9 shows the container system from FIG. 8 with the uppermost inner and outer side wall elements 105, 106 inserted, in the finished, assembled state;

FIG. 10 is a front view of three floor elements 1 disposed next to one another;

FIG. 11 shows the three inserted face wall elements 4 from FIG. 10, which are set into three floor elements 1;

FIG. 12 shows the container system in a setup state with floor elements 1, face wall elements 4 for the first and the second level, inner 5 and outer side wall elements 6, ceiling elements 2, a roof element 7 and push-on connector parts 3;

FIG. 13 shows the two-level container system as in FIG. 12 with a ground level 110 and set-on face wall elements 4 and roof elements 7 for the upper level 120;

FIG. 14 shows the container system from FIG. 13 with a completely inserted uppermost outer side wall element 106 and a halfway inserted uppermost inner side wall element 105, and two side wall elements 105, 106 shown in floating manner;

FIG. 15 shows the finished, assembled container system with a total of six room modules on two levels 110, 120;

FIG. 16*a* is a perspective side view of the floor element 1 which forms the base for the two face wall elements 4;

FIG. 16*b* is an enlarged perspective partial view of the floor element 1 from FIG. 16;

FIG. 17*a* is a perspective view of the floor element 1 with two face wall elements 4 from FIG. 16, where the face wall elements 4 are set onto the floor element 1;

FIG. 17*b* is a detail view of a side push-on connector part 203 with a side groove 208 and a side tongue-and-groove piece 209;

FIG. 18 shows the floor element 1 and the face elements 4 from FIG. 17*a*, but with an additional outer side wall element 6 shown in floating manner;

FIG. 19 shows the floor element 1 and the two face wall elements 4 from FIG. 17*a* with two outer side wall elements 6 inserted into the face wall elements 4;

FIG. 20 shows the floor element 1 and the two face wall elements 4 from FIG. 17*a* and a roof element 2 floating above its inserted position;

FIG. 21 is a perspective side view of an uppermost inner side wall element 105;

FIG. 22 is a perspective side view of an uppermost outer side wall element 106; and FIG. 23 is a perspective side view of a complete room module of the container system.

IV. DETAILED DESCRIPTION OF THE INVENTION

FIGS. 1 to 15, described in the following, show the container system in different setup states. In chronological sequence, the setup of a two-level container system having a ground level and an upper level is shown in a side view, a top view, and a frontal view, in each instance. For reasons of a clear illustration, elements are partly shown "floating" above their inserted position. The arrows shown next to the "floating" elements indicate the direction in which the element is set onto another. Furthermore, elements or components that are covered by other elements are partly shown with broken lines, in order to give an impression of their position in the container system.

Since FIGS. 1 to 4, which are described first, are side views, only one floor element 1, ceiling element 2, and roof element 7, and only the inner side wall element 5 are shown.

Figure 1:
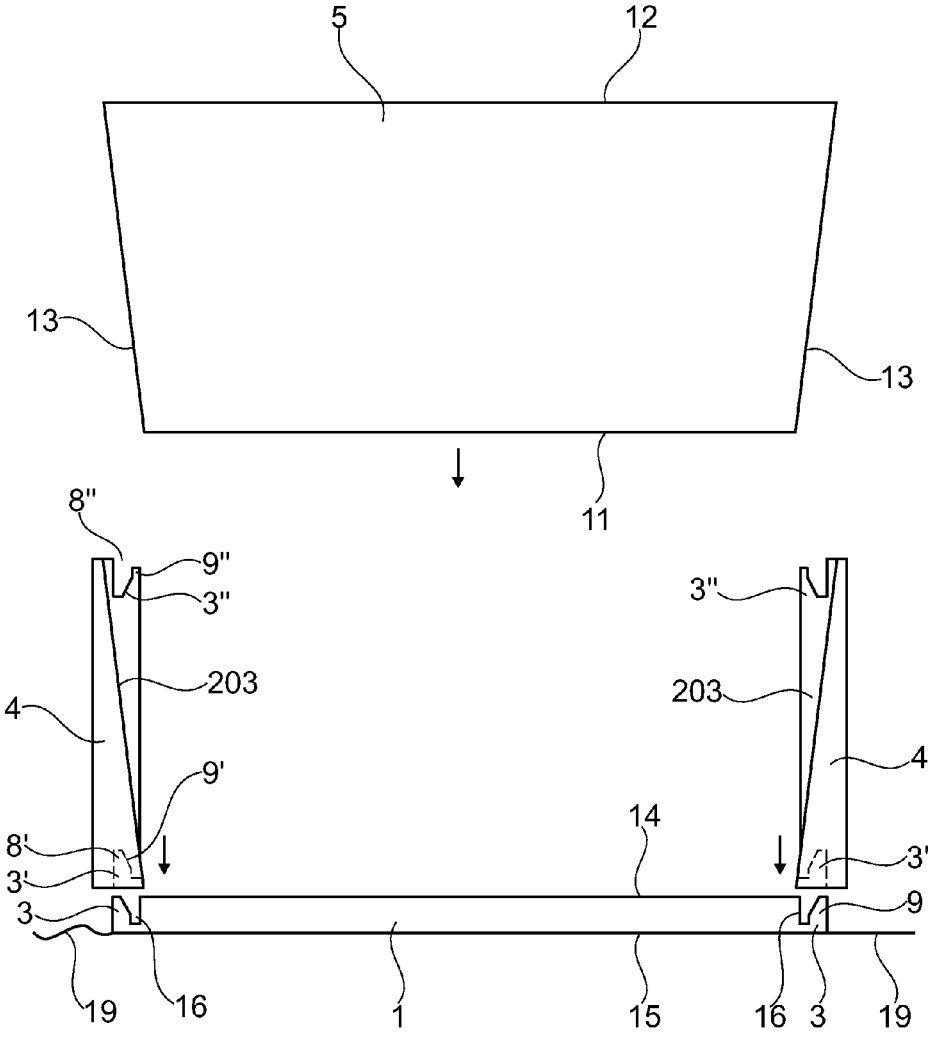

FIG. 1 shows a side view of the container system having a floor element 1, which forms a base for the face wall element 4 and the side wall element 5. For the sake of a clear illustration, the face wall elements 4 and the inner side wall element 5 are shown not in the inserted position, but rather above an inserted position.

The floor element 1 is a rectangular panel having a top 14, an underside 15, and four side surfaces 16. The floor element 1 lies on a ground surface 19 with its underside 15. The top 14 forms a floor that can be walked on. Push-on connector parts 3 are set onto the two side surfaces 16 of the floor element 1 that lie opposite one another. The push-on connector parts 3 of the floor element 1 and of the face wall elements 4 consist of a groove 8 having a tongue-and-groove piece 9 that runs parallel to the latter, so that when the two elements are put together, a push-on connector is formed from two push-on connector parts, with the grooves 8 and tongue-and-groove pieces 9 engaging into one another with shape fit. In the case of the face wall elements 4, the lower grooves 8' and tongue-and-groove pieces 9' are covered, and they are therefore shown with broken lines. The grooves 8 and tongue-and-groove pieces 9 of the floor element 1 are disposed on the top 14 of the floor element 1. The corresponding lower push-on connector parts 3' of the face wall elements 4 are set onto these push-on connector parts 3. The lower push-on connector parts 3' point downward with their contact surfaces, in other words in the direction toward the floor element 1.

The inner side wall element 5 is shaped as a trapezoid panel having a lower base side 11 and an upper base side 12 parallel to the latter, and two trapezoid sides 13 of equal length. In this connection, side 13 and lower base side 11 form an inside angle of greater than 90° in each instance, thereby causing the surface of the side wall element 5 to narrow toward the floor element 1 and to widen in an upward direction. The upper base side 12 is therefore longer than the lower base side 11. Push-on connector parts 103 (not shown, see FIG. 17) are disposed along the two trapezoid sides 13, for a connection with the face wall elements 4, where the trapezoid push-on connector parts 103 have the inclination of the trapezoid sides 13. Matching push-on connector parts 203 (see also FIG. 17) are disposed on the face wall elements 4, which parts have a corresponding direction of inclination. In this manner, the push-on connector parts 3 of side wall element 5 and of face wall elements 4 can be firmly connected.

Because of the trapezoid shape of the inner side wall element 5 and the inclined push-on connectors 3, a component of the force that is produced by the weight of the trapezoid-shaped side wall element 5 acts in the horizontal direction, in other words parallel to the base sides 11, 12. As a result, the push-on connector parts 3 of the side wall element 5 and of the face wall elements 4 are connected with one another with force, and pressed together. Because of this force fit, the side wall element 5 is firmly braced between the two face wall elements 4. The outer side wall elements 6, not shown in FIG. 1, also have the trapezoid shape described.

The face wall elements 4 have upper push-on connector parts 3", each having a groove 8" and a tongue-and-groove piece 9", whose contact surfaces face upward. Either a ceiling element 2 or a roof element 7 (not shown) can be set onto these upper push-on connector parts 3".

At the locations or surfaces where the elements 1, 4, 5 come onto contact with one another in the connected state, they are coated with a hard-rubber seal. In this way, a seal against moisture, weather influences, and the like is guaranteed.

Figure 2:
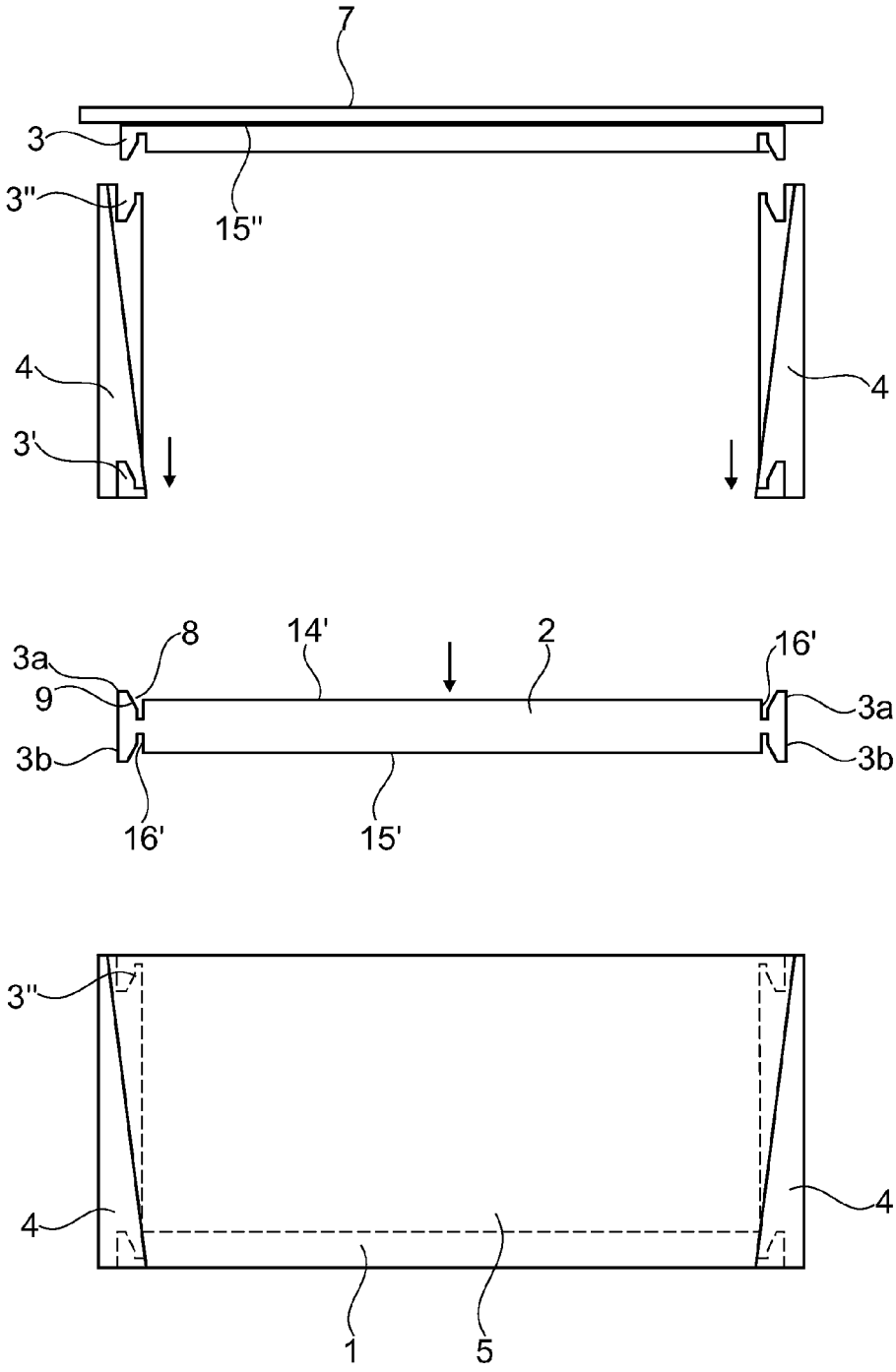

FIG. 2 shows a side view of the container system from FIG. 1 with the floor element 1 shown with a broken line, two face wall elements 4 set on, and an inner side wall element 5 that is inserted between the two face wall elements 4. Above these elements, further elements still to be installed are shown, which float above their intended position for an illustration of this position. These elements are a ceiling element 2, two further face wall elements 4, and, as the top cover, a roof element 7.

The ceiling element 2 is a rectangular panel having a top 14', an underside 15', and four side surfaces 16'. The base surfaces correspond to the base surfaces of the floor element 1 and the roof element 7. A closed room module is formed by means of the floor element 1, the two face wall elements 4 that are set on, the side wall element 5, the ceiling element 2 in the set-on state, and another side wall element 5, not shown. In this connection, the underside 15' of the ceiling element 2 forms the ceiling. The top 14' forms a floor for another room module that lies above it, which can be walked on.

In total, four push-on connector parts 3*a*, 3*b* are set onto the two side surfaces 16' of the ceiling element 2 that lie opposite one another. These push-on connector parts 3*a*, 3*b* consist, as in the case of the floor element 1 and the face wall elements 4, of a groove 8 with a tongue-and-groove piece 9 that runs parallel to the latter, so that when two elements are put together, a push-on connector whose grooves 8 and tongue-and-groove pieces 9 engage into one another, with shape fit, is formed from two push-on connector parts 3.

The two push-on connector parts 3*a* that lie opposite one another are disposed on the top 14' of the ceiling element 2, in other words they face in the direction of the roof element 7 in FIG. 2, so that the lower push-on connector parts 3' of the face wall elements 4 of another level can be set onto the top 14' of the ceiling elements 2. In this connection, the face wall elements 4 are equivalent in construction for all the levels or stories.

In addition, two other push-on connector parts 3*b* that lie opposite one another are provided for the ceiling elements 2, which parts are disposed on the underside 15' of the ceiling element 2, in other words face in the direction of the floor element 1 in FIG. 2, so that the ceiling elements 2 can be set onto the upper push-on connectors 3" of the face wall elements 4 with their underside 15'.

Furthermore, a roof element 7 is shown, which serves as an upper cover for the uppermost levels. Corresponding push-on connector parts 3 are also provided for the roof elements 7, which parts are disposed on the underside 15" of the roof elements 7, in other words face in the direction of the ceiling element 2 in FIG. 2, so that the roof elements 7 can be set onto the upper push-on connector parts 3" of the face wall elements 4 with their underside 15".

Figure 3:
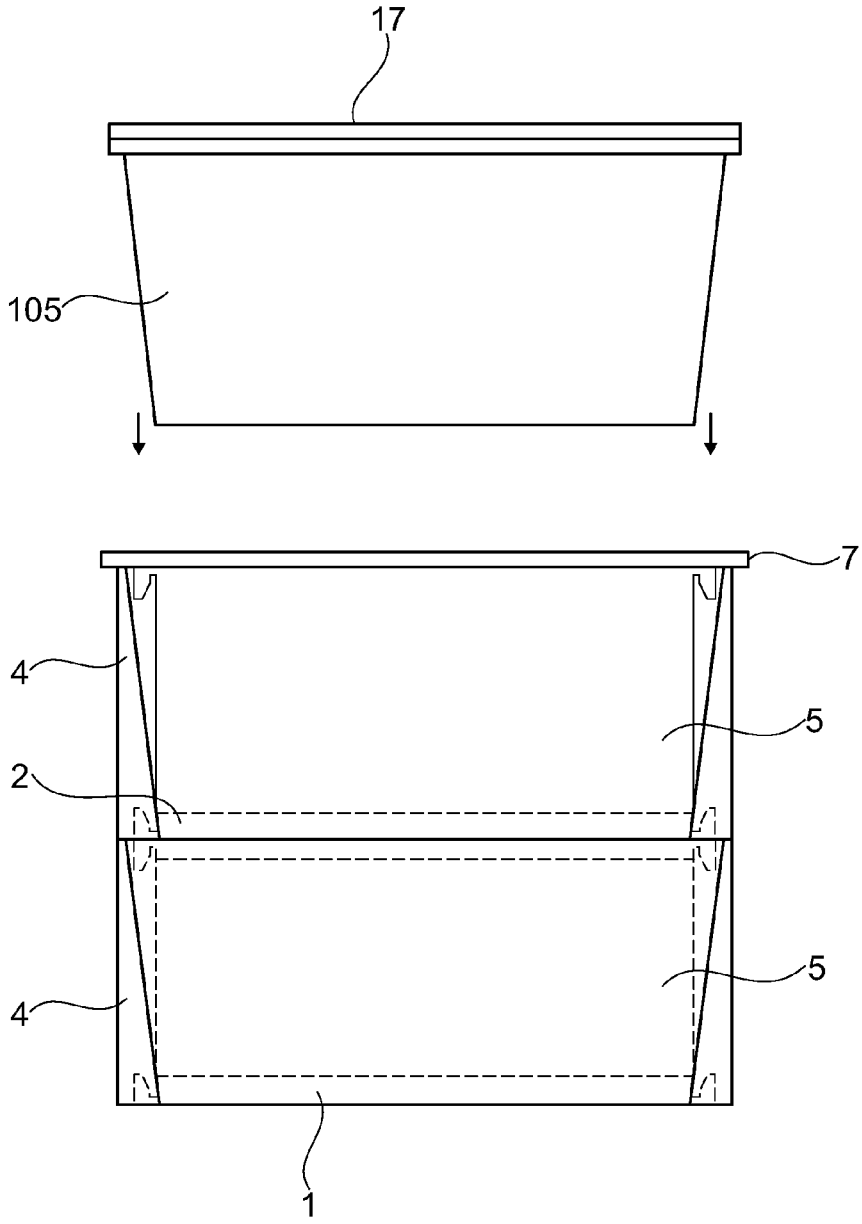
FIG. 3 shows all the elements 1, 2, 4, 5, 7 from FIG. 2 in the assembled state. Above these elements, an uppermost inner side wall element 105 is shown.

FIG. 3 shows all the elements 1, 2, 4, 5, 7 from FIG. 2 in the assembled state. Above these elements, an uppermost inner side wall element 105 is shown, which floats above its intended position for the sake of the illustration.

The following sequence in the assembly of individual elements to form a two-level container system is evident from FIGS. 1 to 3: First, at least one floor element 1 is set onto the ground surface with its underside 15. Then, the face wall elements 4 are set onto the floor element(s) 1. The inner and (not shown) outer side wall elements 5, 6 for the first level, in other words the ground level, are inserted between the face wall elements 4. Afterward, one or more ceiling elements 2 are set onto the face wall elements 4. Then, additional face wall elements 4 are set onto the ceiling elements 2. Then, at least one roof element 7 is set onto the face wall elements 4. Last, further inner and outer side wall elements 105, 106 for the second level, in other words the upper level, are set between the face wall elements 4. These uppermost side wall elements 105, 106 differ from the side wall elements 5, 6 used for the other levels in that they have a thickened region 17 in the contact region of the roof elements 7. The thickened region 17 is disposed on the upper, longer base side 12 of the trapezoid-shaped side wall elements 105, 106. In the inserted state, the side wall elements 105, 106 press onto the roof elements 7 with the thickened region 17, because of their weight, and thereby fix them in place.

Figure 4:
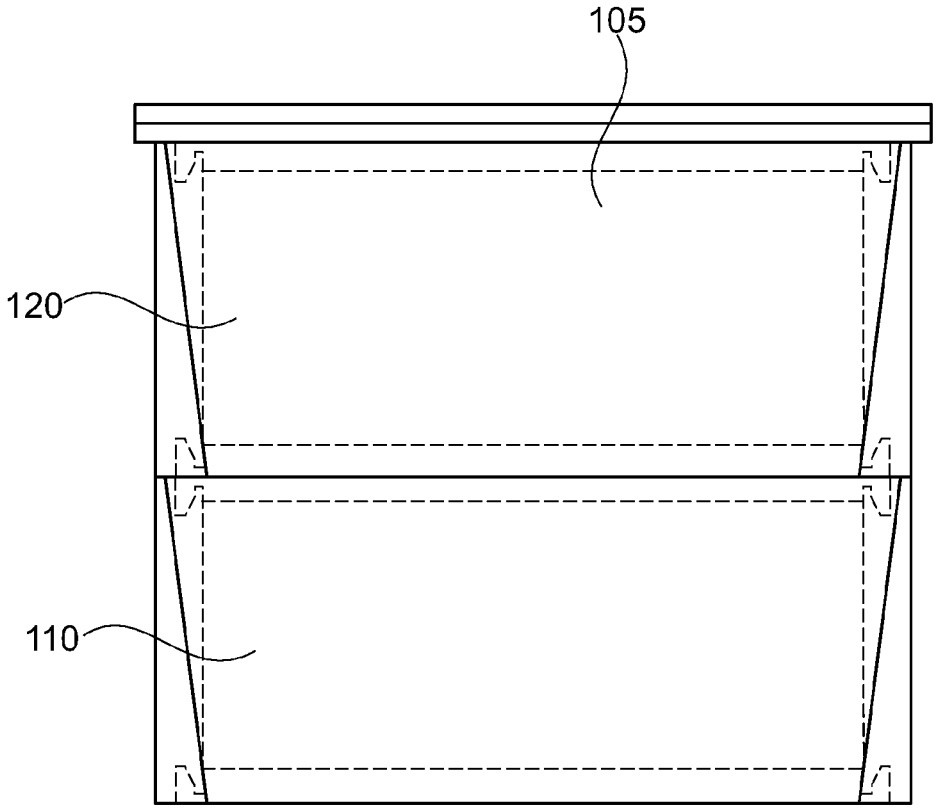
FIG. 4 shows the finished, assembled container system with the uppermost side wall element 105 set in place.

FIG. 4 shows the finished, assembled container system with the uppermost side wall element 105 set in place. Covered parts of components are shown with broken lines. The container system consists of a ground level 110 and an upper level 120. However, the container system according to the invention is not limited to these levels. Fundamentally, as many levels as desired can be set one on top of the other. The only limitation results from the static load and the carrying ability of the elements, particularly that of the face wall elements 4.

The loads of the construction are carried, for the most part, by the face wall elements 4, while the side wall elements 5, 6 transfer only low forces.

FIGS. 5 to 9, described below, show a top view of the container system in different setup states. The construction of a two-level container system having a ground level and an upper level is shown in chronological sequence.

Figure 5:
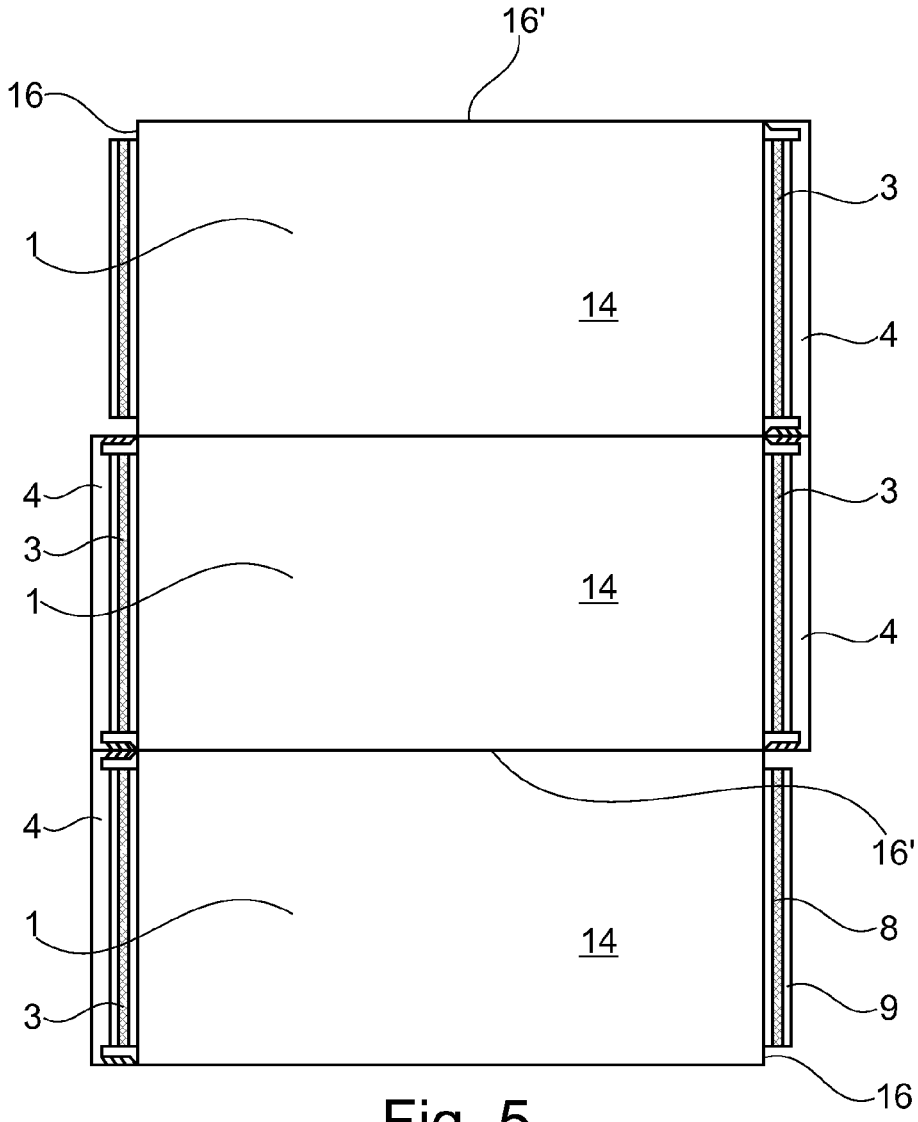
FIG. 5 is a top view of three floor elements 1 that form the base of the container system.

FIG. 5 shows a top view of three floor elements 1 that form the base of the container system. A floor element 1 consists of a rectangular panel that lies on a ground surface 19 (not shown). The top 14 forms a floor that can be walked on. A push-on connector part 3 is set on, in each instance, at the two short side surfaces 16 of the floor element 1 that lie opposite one another. This part consists of a groove 8 with a tongue-and-groove piece 9 that runs parallel to the latter. A face wall element 4 is set onto a total of four push-on connector parts 3, in each instance.

The three floor elements 1 are disposed next to one another on the long side surfaces 16' that lie opposite one another. These long side surfaces 16' do not have any push-on connector parts. However, the container system according to the invention is not limited to the number of three floor elements 1 shown. In principle, as many floor elements 1 as desired can be disposed next to one another, where a top 14 of a floor element 1 forms the base surface for a room module, in each instance.

FIG. 6 shows a top view of three floor elements 1 from FIG. 5 with all six face wall elements 4 set on. From the arrangement of the floor elements 1, it is evident that the face wall elements 4 are always outer walls.

FIG. 7 shows the three floor elements 1 with face wall elements 4 from FIG. 6 set on. In addition, the inner side wall elements 5 and the outer side wall elements 6 have also been set on. Only the outer side wall elements 6, together with the face wall elements 4, form the outer walls of the container system. In this connection, the outer side wall elements 6 differ from the inner side wall elements 5. The inner side wall elements 5 serve not only to partition a room module, but also have the function of connecting two face wall elements, in each instance. For this purpose, the push-on connectors 3 of the inner side wall elements 5 have two tongue-and-groove pieces 9 with a double groove 10 disposed between them.

The two tongue-and-groove pieces 9 of the two push-on connector parts 3 of two face wall elements 4 disposed next to one another, in each instance, jointly engage into a double groove 10 and are thereby connected with the inner side wall element 5. In this way, a side wall element 5 connects two face wall elements 4, with a push-on connector part 3, in each instance, on the trapezoid side 13 (not shown). A push-on connection of three elements therefore exists. In this way, particularly fast setup is possible.

FIG. 8 shows the container system from FIG. 7, where in addition, three ceiling elements 2 (not shown), six upper face wall elements 4 (not shown), and three roof elements 7 are set on. The setup state corresponds to the one shown in FIG. 3. The roof elements 7, like the floor 1 and ceiling elements 2, are essentially rectangular in a top view. As a difference, they have recesses 22 on their long sides, which form a slit 23 when two roof elements 7 are disposed next to one another.

To complete the setup, the uppermost outer side wall elements 106 are set into the recesses 22, and the uppermost inner side wall elements 105 are set into the slits 23 (see FIG. 9).

FIG. 9 shows the container system from FIG. 8 with the uppermost inner and outer side wall elements 105, 106 inserted, in the finished, assembled state. These uppermost side wall elements 105, 106 differ from the side wall elements 5, 6 for other levels in that they have a thickened region 17 for attachment of the roof elements 7 in the contact region of the roof elements 7. The thickened regions 17 cover the recesses 22 or the slits 23. Furthermore, the uppermost side wall elements 105, 106 press down on the roof elements 7 with the thickened region 17, by means of their weight, and thereby fix these in place.

FIGS. 10 to 15 show a front view of the container system in different setup states. Setup of a two-level container system having a ground level 110 and an upper level 120 is shown in chronological sequence, as in FIGS. 1 to 4 and 5 to 9.

FIG. 10 shows a front view of three floor elements 1 disposed next to one another. A face wall element 4 having a window 18 is set onto the floor element l' that is on the outer left in the figure. This floor element l' is covered by the face wall element 4 and is therefore shown with broken lines. The covered push-on connector parts 3 are also shown with broken lines. For reasons of a clear illustration, the center face wall element 4 is shown floating above its inserted position.

FIG. 11 shows the three inserted face wall elements 4 from FIG. 10, which are set into three floor elements 1, shown with broken lines. The outer left side wall element 6 is inserted completely, and the related inner side wall element 5 that forms a room module is inserted halfway. Another inner side wall element 5 and an outer side wall element 6 are shown in floating manner. The push-on connector parts 3 on the side wall element 5, 6 are shown with cross-hatching. A double groove 10 for connection of two face wall elements 4, in each instance, is provided on the two inner side wall elements 5. The vertical arrows indicate the insertion direction.

FIG. 12 shows the container system in a setup state with floor elements 1 (shown with broken lines), face wall elements 4 for the first and the second level, inner 5 (shown with broken lines) and outer side wall elements 6, ceiling elements 2, and a roof element 7. Covered push-on connector parts 3 are shown with broken lines.

FIG. 13 shows the two-level container system as in FIG. 12 with a ground level 110 and set-on face wall elements 4 and roof elements 7 for the upper level 120.

FIG. 14 shows the container system from FIG. 13 with a completely inserted uppermost outer side wall element 106 and a halfway inserted uppermost inner side wall element 105, and two side wall elements 105, 106 shown in floating manner. The uppermost side wall elements 105, 106 for the uppermost level differ from the side wall elements 5, 6 for the other levels in that thickened regions 17 are provided in the contact region of the roof elements 7. The thickened regions 17 have a holding surface 20 for the roof elements 7 that is slanted in the direction of the roof elements 7. The side wall elements 105, 106 exert a force on the roof elements 7 with the holding surface 20, by means of their weight, and thereby fix these in place. Since the side wall elements 105, 106 are not bearing elements, but rather are suspended or inserted into the face wall elements 4, they exert a force on the roof elements 7 by means of their weight, and fix these in place with the holding surface 20. For this purpose, the roof elements 7 have corresponding slanted surfaces 217 for the holding surfaces 20. The thickened regions 17 of the uppermost inner side wall elements 105 have two holding surfaces 20 that are disposed opposite one another, while the holding surfaces 20 of the uppermost outer side wall elements 106 have only one holding surface 20, in each instance.

FIG. 15 shows the finished, assembled container system with a total of six room modules on two levels 110, 120.

FIGS. 16 to 23, described in the following, show the components of the container system, as described above, in a perspective side view, where for reasons of a clear illustration, surfaces of the components are partly shown to be transparent, in order to allow a view into the interior of the components, as in the case of a wire lattice model, and to illustrate their function.

FIG. 16*a* shows a perspective side view of the floor element 1, which forms the base for the two face wall elements 4 and the side wall elements 5 (not shown). For a clear illustration, the face wall elements 4 are shown not in the inserted position, but above their inserted position.

The floor element 1 is a rectangular panel on the two side surfaces 16 that lie opposite one another push-on connector parts 3 set on. The corresponding lower push-on connector parts 3' of the face wall elements 4 are set onto these push-on connector parts 3. A contact strip 21 is provided on the two longer side surfaces 16, in each instance. This strip serves as a contact surface for the side wall elements 5, 6, 105, 106. The face wall elements 4 furthermore have upper push-on connector parts 3" for ceiling 2 or a roof elements 7 (not shown).

The push-on connector parts of all the components 3 or 3' or 3" consist of a groove 8 having at least one tongue-and-groove piece 9 that runs parallel to it, so that when they are put together, a push-on connector is formed from two push-on connector parts that engage into one another with shape fit.

FIG. 16*b* shows an enlarged perspective partial view of the floor element 1 from FIG. 16, with the push-on connector 3, which consists of a groove 8 with a tongue-and-groove piece 9 that runs parallel to it, and the contact strip 21.

FIG. 17*a* shows a perspective view of the floor element 1 with two face wall elements 4 from FIG. 16, where the face wall elements 4 are set onto the floor element 1. The trapezoid-shaped inner side wall element 5 is shown floating above its inserted position (see FIG. 19). Inclined push-on connector parts 103, 203 are provided for inserting the side wall element 5 into the face wall elements 4. The trapezoid push-on connector parts 103 are disposed along the two trapezoid sides 13 and have their inclination. Matching side push-on connector parts 203 having a corresponding direction of inclination are disposed on the face wall elements 4.

The face wall elements 4 therefore have a total of four push-on connector parts, an upper 3" and a lower 3' push-on connector part and two inclined side push-on connector parts 203.

The inner side wall element 5 can have a door or an opening (not shown) as a passage for an adjacent room module.

As FIG. 17*b* shows, in a detail view of the face wall element 4, a side push-on connector parts 203 of the face wall element 4 consist of a side groove 208 with a side tongue-and-groove piece 209 that runs to it. The trapezoid push-on connector parts 103 have corresponding grooves and a tongue-and-groove pieces (not shown), so that during assembly, a push-on connector is put together from two push-on connector parts 103 and 203 that engage into one another with shape fit. Therefore, all the push-on connectors described here have similar characteristics and the same principle of effect.

FIG. 18 shows the floor element 1 and the face elements 4 from FIG. 17*a*, but with an additional outer side wall element 6 shown in floating manner. This element consists of a trapezoid-shaped panel 30 that corresponds to the inner side wall element 5 from FIG. 17. In addition, it has a square cover plate 31 connected with the trapezoid-shaped panel 30. The square cover plate 31 is shown to be transparent and thus shows the trapezoid-shaped panel 30 disposed behind it, in the viewing direction.

FIG. 19 shows the floor element 1 and the two face wall elements 4 from FIG. 17*a*. In addition, two outer side wall elements 6 are inserted into the face wall elements 4. In this connection, the rectangular cover plate 31 completely covers the side surfaces of the face wall elements 4. A ceiling element 2 is shown floating above its inserted position. It has an upper 3*a* and a lower push-on connector 3*b* on its shorter side surfaces, in each instance, as well as a contact strip 21 on the longer side surfaces, in each instance, for side wall elements 5, 6, 105, 106 to make contact. The ceiling element 2 can have an opening with a set of stairs (not shown), in order to allow access to a lower or upper level.

FIG. 20 shows the floor element 1 and the two face wall elements 4 from FIG. 17*a* and, in addition, a roof element 2 floating above its inserted position.

FIGS. 21 and 22 show perspective side views, in each instance, of an uppermost inner side wall element 105 and an uppermost outer side wall element 106. These uppermost side wall elements 105, 106 differ from the other side wall elements 5, 6 used for the other, lower levels, in that they have a thickened region 17 in the contact region of the roof elements 7. The thickened region 17 is disposed on the upper, longer base side 12 of the trapezoid-shaped side wall elements 105, 106. In the inserted state, the side wall elements 105, 106 press down on the roof elements 7 with the thickened region 17, by means of their weight, and thereby fix these in place.

FIG. 23 shows a perspective side view of a complete room module of the container system according to the invention. The room module comprises a floor element 1, two face wall elements 4 inserted into the floor element 1, a roof element 2 inserted into the face wall elements 4, an uppermost outer side wall element 106, which is shown to be transparent, set onto the face wall elements 4, and an uppermost inner side wall element 105 set onto the face wall elements 4.

The container system described can be stored and transported in space-saving manner, can be set up quickly and easily by means of the push-on connectors, and can be used and expanded in flexible manner.

V. REFERENCE SYMBOL LIST

1. Floor element
2. Ceiling element
3. Push-on connector part
4. Face wall element
5. Inner side wall element
6. Outer side wall element
7. Roof element
8. Groove
9. Tongue-and-groove piece
10. Double groove
11. Lower base side
12. Upper base side
13. Trapezoid side
14. Top of the floor, ceiling, or roof elements
15. Underside of the floor, ceiling, or roof elements
16. Side surface of the floor, ceiling, or roof elements
17. Thickened region
18. Window
19. Ground surface
20. Holding surface
21. Contact strip
22. Recess
23. Slit
30. Trapezoid panel
31. Cover plate
103. Trapezoid push-on connector part
105. Uppermost inner side wall element
106. Uppermost outer side wall element
110. Ground level
120. Upper level
203. Side push-on-connector part
208. Side groove
209. Side tongue-and-groove piece
217. Slanted surfaces

The invention claimed is:

1. A modular container system with at least one room module for creating block-shaped room modules for living or working purposes, which are disposed next to and on top of one another, wherein the at least one room module comprises, in each instance:

a) a floor element or ceiling element that serves as a lower base, having push-on connector parts for releasable attachment of two face wall elements that lie opposite one another;

b) two face wall elements having lower push-on connector parts for releasable attachment of the floor element or ceiling element and having upper push-on connector parts for releasable attachment of an upper ceiling element or roof element, as well as side push-on connector parts for a connection with side wall elements;

c) two side wall elements having trapezoid push-on connector parts for a connection with the face wall elements;

d) a ceiling element or roof element that serves as an upper cover, having push-on connector parts for releasable attachment to the face wall elements wherein the push-on connector parts of the ceiling element, the push-on connector parts of the floor element, the trapezoid push-on connector parts of the side wall elements and the side push-on connector parts of the face wall elements, in each instance, have a groove with at least one tongue-and-groove piece that runs parallel to the groove, so that in the case of a push-on connector consisting of push-on connector parts that have been put together, the grooves and tongue-and-groove pieces engage into one another with shape fit, with their contact surfaces;

e) the side wall elements are shaped as a trapezoid having a lower base side and an upper base side that runs parallel to the latter, and two trapezoid sides of equal length, where the trapezoid sides and the lower base side form an inside angle of greater than 90°, in each instance, thereby causing the surface area of the side wall elements to narrow toward the lower floor or ceiling element, and to widen toward the upper ceiling or roof element, where trapezoid push-on connector parts for a connection with the face wall elements run along the trapezoid sides and have the same inclination as the trapezoid sides; and f) the side push-on connector parts of the face wall elements for a connection with the side wall elements have the same direction of inclination, in order to be able to be connected with them.

2. The modular container system according to claim 1, characterized in that a common, inner side wall element is provided for two room modules disposed next to one another, in each instance, as an inner wall.

3. The modular container system according to claim 2, characterized in that the inner side wall elements have push-on connectors having two tongue-and-groove pieces and a double groove disposed between them, so that in the connected state, the two tongue-and-groove pieces of the two push-on connector parts of two face wall elements disposed next to one another jointly engage into the double groove, and one of the two tongue-and-groove pieces of the inner side wall element, in each instance, engages into a groove of the push-on connector part of a face wall element, in each instance, in order to connect two face wall elements and to connect them with an inner side wall element.

4. The modular container system according to claim 1, characterized in that all the face wall elements and the outer side wall elements of the container system form the outer walls of the container system.

5. The modular container system according to claim 1, characterized in that the floor, ceiling, or roof elements are configured as rectangular panels, having a top, an underside, and four side surfaces, in each instance, where the push-on connector parts for a connection to the face wall elements are disposed, in particular, on two side surfaces that lie opposite one another, in each instance, and the longitudinal axes of groove and tongue-and-groove piece run parallel to the side surfaces.

6. The modular container system according to claim 1, characterized in that the face wall elements have an upper and a lower push-on connector part.

7. The modular container system according to claim 1, characterized in that for the floor elements, push-on connector parts having a groove and a tongue-and-groove piece are provided, which are disposed on the top of the floor elements, so that the lower push-on connector parts of the face wall elements can be set onto the top of the floor element.

8. The modular container system according to claim 1, characterized in that for the roof elements, push-on connector parts having a groove and a tongue-and-groove piece are provided, which are disposed on the underside of the roof elements, so that the roof elements can be set onto the upper push-on connector parts of the face wall elements with their underside.

9. The modular container system according to claim 1, characterized in that for the ceiling elements, push-on connector parts having a groove and a tongue-and-groove piece are provided, which are disposed on the top of the ceiling elements, so that the lower push-on connector parts of the face wall elements can be set onto the top of the ceiling elements, and that further push-on connector parts having grooves and tongue-and-groove pieces are provided for the ceiling elements, which parts face on the underside of the ceiling elements, so that the ceiling elements can be set onto the upper push-on connector parts of the face wall elements with their underside.

10. The modular container system according to claim 1, characterized in that the side wall elements for the uppermost level have attachment elements for attachment of the roof elements in the contact region of the roof elements.

11. The modular container system according to claim 1, characterized in that the attachment elements are configured as a thickened region that runs longitudinally or as a projection that runs longitudinally, having a holding surface for the roof elements, so that in the assembled state, the uppermost side wall elements exert a force on the roof elements by means of their weight, with the holding surface, and hold them in place.

12. The modular container system according to claim 1, characterized in that the outer side wall elements have a cover plate that is rectangular.

13. The modular container system according to claim 1, characterized in that the components of the container system have a hard-rubber seal, at the locations or surfaces where they come into contact with one another in the connected state.

14. The modular container system according to claim 1, characterized in that the face wall elements have doors and/or windows.

15. The modular container system according to claim 1, characterized in that the side wall elements have passage openings or doors.

* * * * *